US005500983A

United States Patent [19]

Lautenschläger

[11] Patent Number: 5,500,983

[45] Date of Patent: Mar. 26, 1996

[54] CORNER CABINET HINGE

[75] Inventor: Reinhard Lautenschläger, Reinheim, Germany

[73] Assignee: Mepla Werke Lautenschlager GmbH & Co. KG, Germany

[21] Appl. No.: 236,469

[22] Filed: Apr. 28, 1994

[30] Foreign Application Priority Data

May 7, 1993 [DE] Germany ..... 43 15 159.0

[51] Int. Cl.[6] ..... E05F 1/08

[52] U.S. Cl. ..... 16/304; 16/292; 16/297

[58] Field of Search ..... 16/303, 304, 327, 16/321, 292, 293, 297, 325, 334, 335, DIG. 43

[56] References Cited

U.S. PATENT DOCUMENTS

| | | | |
|---|---|---|---|
| 1,122,322 | 12/1914 | Smith | 16/292 |
| 3,835,585 | 9/1974 | Anderson . | |
| 3,940,828 | 3/1976 | Lautenschlager | 16/303 |
| 4,083,082 | 4/1978 | Holmes | 16/303 |
| 4,310,948 | 1/1982 | Röck et al. | 16/335 |
| 4,352,222 | 10/1982 | Mages et al. | 16/304 |
| 4,819,298 | 4/1989 | Lautenschlager | 16/292 |
| 4,884,317 | 12/1989 | Liu | 16/297 |
| 4,987,640 | 1/1991 | Lin . | |
| 5,150,500 | 9/1992 | Bisbing | 16/247 |
| 5,353,476 | 10/1994 | Domenig | 16/247 |

FOREIGN PATENT DOCUMENTS 9203048 6/1992 Germany .

*Primary Examiner*—Maurina Rachuba
*Assistant Examiner*—Chuck Y. Mah

[57] ABSTRACT

The invention relates to a corner cabinet hinge (30) for hanging a free panel (14b) of a two-panel corner cabinet door (14) on the panel (14a) that is hung by a hinge on the carcase supporting wall. The hinge (30) has two members which are associated one with each of the door panels and which are formed as a hinge cup (38) disposed in one of the door panels, and as a hinge arm (34) mounted rotatably in the hinge cup and adjustably fastened to the other door panel. In the area where the hinge arm (34) is journaled in the hinge cup (38) a thrusting device is provided which in the closed position of the door (14) biases the door panel into a position in which the panel assumes an angle of slightly more than 90°. The thrusting device has a pusher displaceably mounted in the hinge cup and biased against the end of the hinge arm that is journaled in the hinge cup, plus a cam surface formed on this end of the hinge arm, which the pusher attacks.

16 Claims, 7 Drawing Sheets

CORNER CABINET HINGE

BACKGROUND OF THE INVENTION

1. Field of the Invention

The invention relates to a hinge for hanging the free panel of a bipartite corner cabinet door on the panel that is hung to turn on the carcase supporting wall, consisting of two mounting parts each associated with the door panels, which can be turned by about 90 degrees, from the position wherein the door panels are held approximately at right angles to one another when the corner cabinet is closed, to a position substantially in parallel alignment when the corner cabinet door is open, one of the mounting parts having a hinge cup which can be fixed in one door panel and in which a multi-angled hinge arm which can be adjustably fastened to the other door panel is journaled at one end on a pivot pin provided in the hinge cup, and, in the area where the hinge arm is journaled in the hinge cup, a thrusting means is provided which urges the free panel to a position assuming an angle of slightly more than 900 relative to the first panel hinged on the carcase.

2. The Prior Art

Corner cabinets which fill the corner areas between two rows of built-in cabinets set at right angles to one another are used especially in built-in cabinet layouts intended for kitchens, both on floor cabinets and in wall-hung cabinets. The door closing the corner cabinet carcase is divided, on account of space requirements, into two panels, one of which is hung by conventional hinges—self-closing hinges as a rule—on a supporting wall of the cabinet carcase, while the second, free panel is hinged in turn on the first panel hung on the carcase such that when the door is closed it will be at right angles to the first panel, but after the cabinet is opened it can be swung to a position aligned approximately parallel with the first panel. To hinge the two panels together, so-called piano hinges were originally used, which have the disadvantage, however, that no catch mechanism nor any overdraw restraint can be integrated into them to hold the free panel pressed against the associated part of the carcase in the closed state of the door. Even when the carcase-mounted panel was hung on the carcase with normal over-center hinges, the free door panel then had to be held closed by a separate catch mechanism, a magnetic catch for example. Since such catch mechanisms separate from the hinge mechanism have components to be attached to the carcase, which are visible when the door is open, and which impair the appearance of the (open) corner cabinet and can interfere with access to them, special corner cabinet hinges (DE-OS 37 29 531) have been developed, in which the hinge members turning on one another are coupled by an elongated strap or strip-like connector which is articulated on the one hinge member and slides lengthwise on the other hinge member, wherein the connector is not only part of a catch mechanism but also works as an over-draw restraint which prevents the panels from turning relative to one another beyond a certain angular limit.

One problem of corner cabinet hinges is also that the thickness of the door panels to be coupled together by the corner cabinet hinges varies between, say, 16 and 22 millimeters. Since corner cabinets amount to only a small percentage of kitchen cabinet plans, such corner cabinet hinges are needed relatively rarely, so that due to their complex construction and short production runs in comparison to ordinary cabinet hinges they are sometimes relatively expensive. If corner cabinet hinges of different dimensions would have to be used for door panels of various thickness, this would result in a still further increase in cost. Corner cabinet hinges must therefore be designed so that they will be usable for door panels within the material thickness range in question, i.e., they must be adjustable to the thickness of the panels. Due to the special motion requirements in corner cabinet doors, the adjustability between the hinge arm and the mounting plate in standard hinges does not, as a rule, suffice to cover the entire range of door panels of different thickness by the adjustment of the hinge. Therefore corner cabinet hinges of the kind described above have already been developed (EP-OS 0 463 439) in which the angular hinge arm is additionally divided into sections which are adjustable with respect to one another. The combination of possible adjustments of the hinge arm on a mounting plate and of the arm sections relative to one another then makes it possible to use the same corner cabinet hinge for hanging doors of different thickness.

SUMMARY OF THE INVENTION

It is the object of the invention to offer a corner cabinet hinge whose operation is further improved in comparison to the known corner cabinet hinges, and which can be manufactured economically.

Starting out from a hinge of the kind mentioned in the beginning, this object is achieved according to the invention in that the system for holding doors shut has a pusher mounted displaceably in the hinge cup and resiliently biased toward the pivot pin, and a cam surface which is formed on the bearing sleeve surrounding the pivot pin at the free end of the hinge arm and engaged by the pusher.

In a preferred embodiment of the invention, in which the hinge arm is adjustably mounted on a mounting plate fastened to the door panel, adaptation of the hinge arm to different thicknesses of the panels is accomplished by providing mounting plates of various thicknesses which mount the hinge arm at different distances from the inside surface of the associated door. The actual corner cabinet hinge is thus usable without modification for door panels of different material thickness, and only the mounting plate holding the hinge arm on the associated panel needs to have a different thickness corresponding to the material thickness of the panels, and has to be mounted with its distance from the adjacent panel edge adapted accordingly. Since furthermore, however, the mounting plates commonly used with normal furniture hinges can be used, it is possible to make the hinge arm so as to be able to snapped on and off from the mounting plate in a manner known in itself, which permits rapid and simple installation of the door panels.

Instead of using mounting plates of different thickness for door panels of different material thickness, it is also possible, of course, to use a (thin) standard mounting plate, which in the case of greater door panel thicknesses will be mounted with an appropriate shim on the associated door panel.

In another, different embodiment, the configuration is such that the hinge arm is composed of a total of three arm sections releasably joined together and succeeding one another in the longitudinal direction. The bearing arm section pivotingly mounted in the hinge cup is connected to the middle, connecting arm section for adjustment in a first coordinate direction, and the middle connecting arm section is adjustably joined to the mounting arm section affixed unrotatably to the other door panel for adjustment in a direction running at right angles to the first coordinate direction, and the mounting arm section is in turn mounted for adjustment in a coordinate direction running substantially at right angles to the above-named coordinate directions on a mounting means fastened to the associated door panel.

The configuration is preferably made such that the coordinate direction determining the direction of adjustment between the bearing arm section and the connecting arm section, and the coordinate direction determining the direction of adjustment between the connecting arm section and the mounting arm section, are at right angles to the longitudinal central axis of the pivot pin, and the coordinate direction determining the adjustment direction between the connecting arm section and the mounting arm section are aligned parallel to the longitudinal central axis of the pivot pin. The last-named possibility of adjustment between the connecting arm section and the mounting arm section serves not for adaptation to the thickness of the door panel, but permits the panels to be adjusted for level relative to one another.

The mounting element is best fastened sunken in the associated door panel in the manner of a hinge cup, since in this manner an overall more compact configuration of the hinge is achieved, as well as one less apparent when the door is opened.

The mounting element in that case can best have a bearing surface for an associated fastening surface provided on the mounting arm section, while in the fastening surface there is provided a slot through which passes the shaft of a screw which can be threaded into a tap in the bearing surface. The mounting arm section can then be fastened on the mounting means for adjustment within the length of the slot.

In the confronting mounting and fastening surfaces, it is desirable to provide parallel ridges running at right angles to the slot, which can be forced into positive engagement with one another by tightening the set screw.

In like manner, fastening surfaces can be provided on the mounting arm section and in the connecting arm section, which can brought into contact with one another, a slot being provided in one of the arm sections, through which the shaft of a screw passes which can be driven into a thread in the fastening surface of the other arm section.

Here, again, it is expedient to provide in the confronting fastening surfaces parallel ridges running at right angles to the slot, which are forced into positive engagement by the tightened screw.

Lastly, fastening surfaces which can be brought into contact with one another are provided also in the connecting arm section and in the bearing arm section, the arm sections again being joined adjustably to one another by a screw whose shaft passes through a slot provided in one arm section and into a thread in the fastening surface of the other arm section.

Here too the securing of an adjusted position is best again performed by parallel ridges running at right angles to the slot in the arm section.

If the mounting element is sunken in the manner described above in the associated door panel, it is recommendable to configure the mounting element and the hinge cup on which the bearing arm section pivots as identical components, which thus have not only bores to accommodate a pivot pin inside of the cup, but also as a contact surface for the adjustable mounting of a mounting arm section.

Preadjustment of the corner cabinet hinge to the thickness of the door panels that are to be hinged together becomes possible if a scale enabling the relative positions of the arm sections or parts to one another to be read is provided on the bearing arm section as well as on the mounting arm section and on the mounting means holding it, and a pointer is provided on the other arm section or portion. At the same time the scale can be provided with measurement numbers indicating the correct setting for door panels of a particular thickness.

The configuration of the corner cabinet hinges is advantageous in that the hinge cup in which the free end of the hinge arm is pivoted is provided in the door panel that is hung on the carcase and the hinge arm is thus adjustably fastened on the free door panel.

BRIEF DESCRIPTION OF THE DRAWINGS

The invention is further explained in the following description of two embodiments in conjunction with the drawing wherein.

DETAILED DESCRIPTION OF THE PREFERRED EMBODIMENTS

Figure 1:
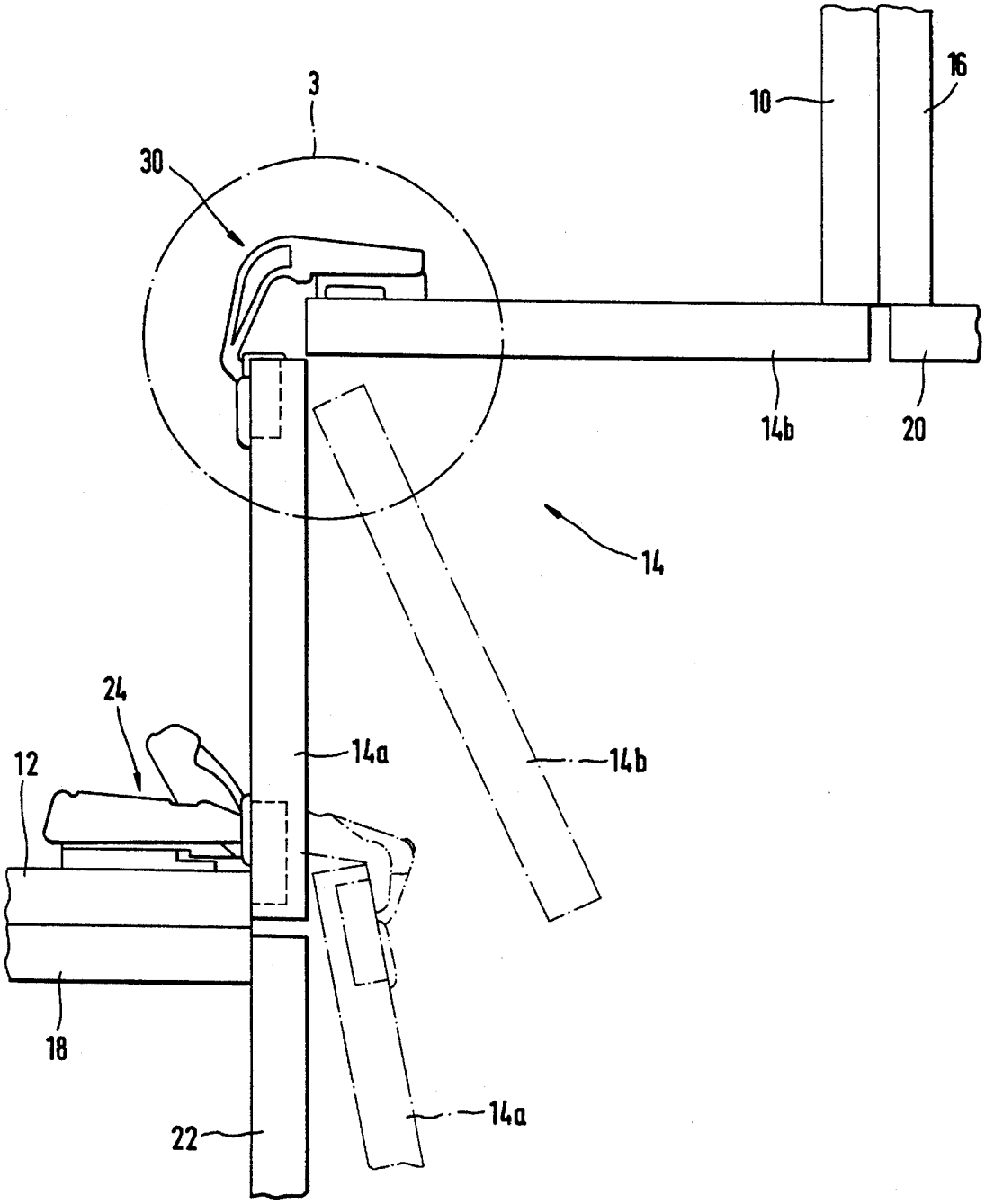
FIG. 1 is a schematic top view of the front of a corner cabinet closed by a bipartite door, with additional cabinets adjoining it on both sides, the door being shown in the closed position. Additionally, the outer panel is shown in an open position separate from the panel hung on the carcase, and also the panel hung on the carcase is shown in broken lines, swung into the open position completely exposing the corner cabinet.
Figure 2:
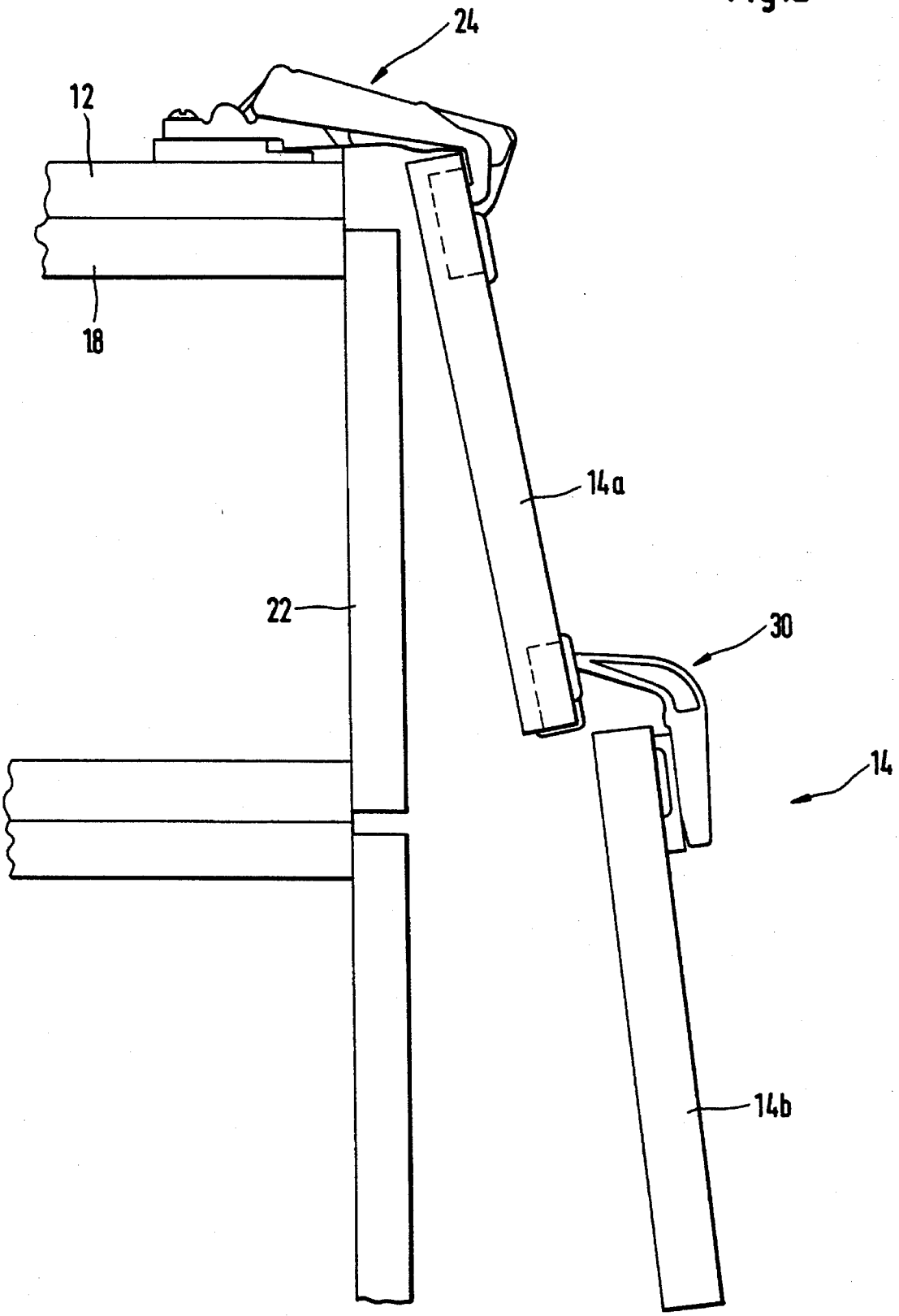
FIG. 2 is a representation corresponding to FIG. 1 of the corner cabinet door swung to the fully open position in front of the adjoining cabinets.

FIG. 1 shows schematically a top view of the front area of a corner cabinet, of which only the two perpendicular carcase side walls 10 and 12 and the bipartite door 14 closing the corner cabinet are shown. The corner cabinet door 14 is composed of two panels **14*a* and 14*b*, of which the first panel 14*a* is hung on the lower, horizontal side wall 14 (although actually the left vertical side wall as seen by looking forward into the cabinet interior) by means of conventional wide-angle hinges 24 provided with an integrated over-center mechanism. At the free vertical edge of this door panel 14***b* hung on the carcase the second, or free, panel 14*b* is hung by means of hinges 30 of the invention which will be described in detail below in connection with FIGS. 3 and 4. It is thus possible to open the door 14 of the corner cabinet by first opening panel 14*b* against the holding force of the hinges 30 linking it in the end position to door panel 14*a*, this panel 14*b* being able to be swung to the position represented in broken lines wherein the portion of the corner cabinet heretofore closed by this panel is now accessible. On the other hand, after the partial opening of panel 14*b*, the door 14 can also swing as a whole to the position shown in FIG. 2 over the laterally adjacent cabinets, and then the part of the corner cabinet that was still closed by door panel 14a is accessible.

Figure 3:
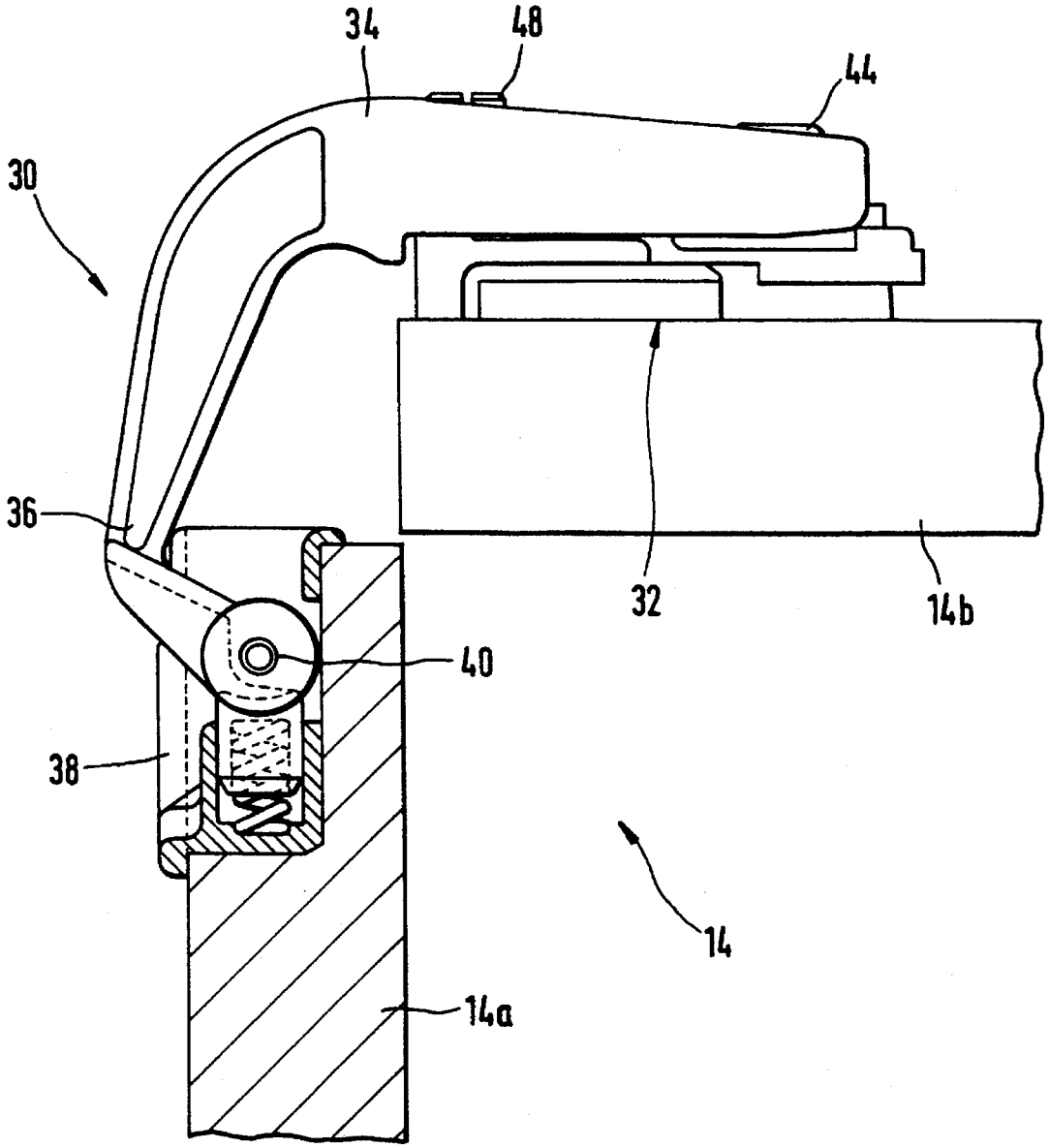
FIG. 3 is an enlarged view of the area represented within the circle 3 in FIG. 1.
Figure 4:
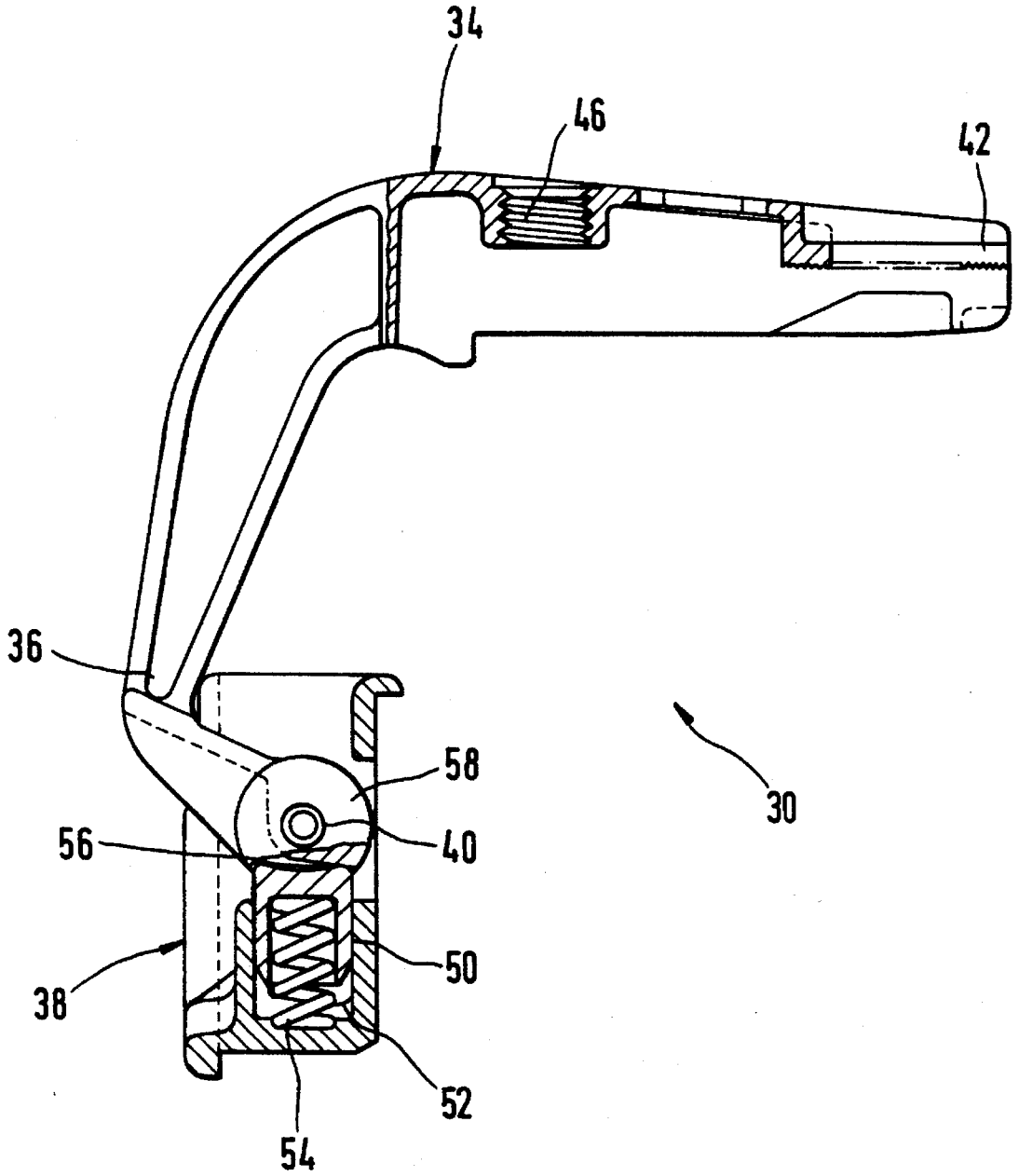
FIG. 4 shows the embodiment, represented in FIG. 3, of a corner cabinet hinge according to the invention, partially in a side view and partially cut away.

In FIGS. 3 and 4 there is shown a first embodiment of the corner cabinet hinge 30 forming the subject matter of the invention. The hinge 30 is basically a single-joint hinge whose mounting members associated with the door panels 14*a* and 14*b* are similar to the mounting members of normal hinges. Thus, the mounting part of the hinge associated with door panel 14*b* is an elongated hinge arm 24 which can be fastened adjustably on a mounting plate 32, and, unlike the supporting arms of hinges for normal cabinets, its multi-angled front end is carried at the joint in a hinge cup 38 mortised in door panel 14*a* and is mounted for pivoting about a pivot pin held in the hinge cup. The adjustable mounting of the hinge arm 34 on the mounting plate 32 is of the same configuration as in normal hinges, so that the configuration of the hinge arm in this area, as well as the configuration of the mounting plate fastened on the inside of the door panel 14*b*, does not need to be described in detail. In this special case the hinge arm 34 has in its part that is to be fastened on the mounting plate the usual elongated shape of inverted U cross section, and has at the end remote from the joint, in its upper web joining together the two lateral U-shaped flanges, an open-ended slot 42 (FIG. 4) for a mounting screw 44 (FIG. 3) which can be driven into the mounting plate 32. Toward the joint a tap 46 is provided in the web, into which a screw 48 is driven, on whose bottom end adjacent the mounting plate (not shown) a holding head is provided, which is held at its top for longitudinal displacement in an associated elongated opening that is open at the front end and has a width smaller than the diameter of the holding head. The mounting plate 32, not shown in detail, can otherwise be bipartite in the manner disclosed in German Patent 38 03 830, while the upper part of the mounting plate is releasably held on the bottom part of the mounting plate by a detent means. The use of such a mounting plate has the advantage that the hinge arm 34 fastened on the upper part of the mounting plate can be disengaged quickly and easily from the bottom part of the mounting plate and replaced thereon just as quickly. That is to say, such disengagement can be made very easily and quickly, while the setting of the supporting arm on the mounting plate 32 remains preserved once it has been established.

The hinge cup 38 is sunk in a mortise that breaks through the edge of door panel 14*a* and is also open at the face, so that the angled front portion at the joint of the hinge arm 34 can pass through the opening in the circumferential wall.

A thrusting means is integrated into the hinge cup and consists of a pusher 50 which is guided for displacement in a mating opening 52 in the hinge cup and is urged by a coil spring 54 under compression out of the opening 52 into engagement with a cam surface 56 which is formed on the bearing sleeve 58 at the free end of the hinge arm 34 containing the pivot pin 40. The shape of the cam surface 56 and the associated end of the pusher 50, which are forced against one another under bias, are selected in the closed position of the corner cabinet shown in the closed position in FIG. 3 such that the door panel 14*b* is urged slightly still further in the direction of an enlargement of the right angle beyond the position of the door panels shown in the Figure at 90° to one another. This assures that the margin of the panel 14*b* will be urged in any case into contact with the carcase side wall 10.

Figure 5:
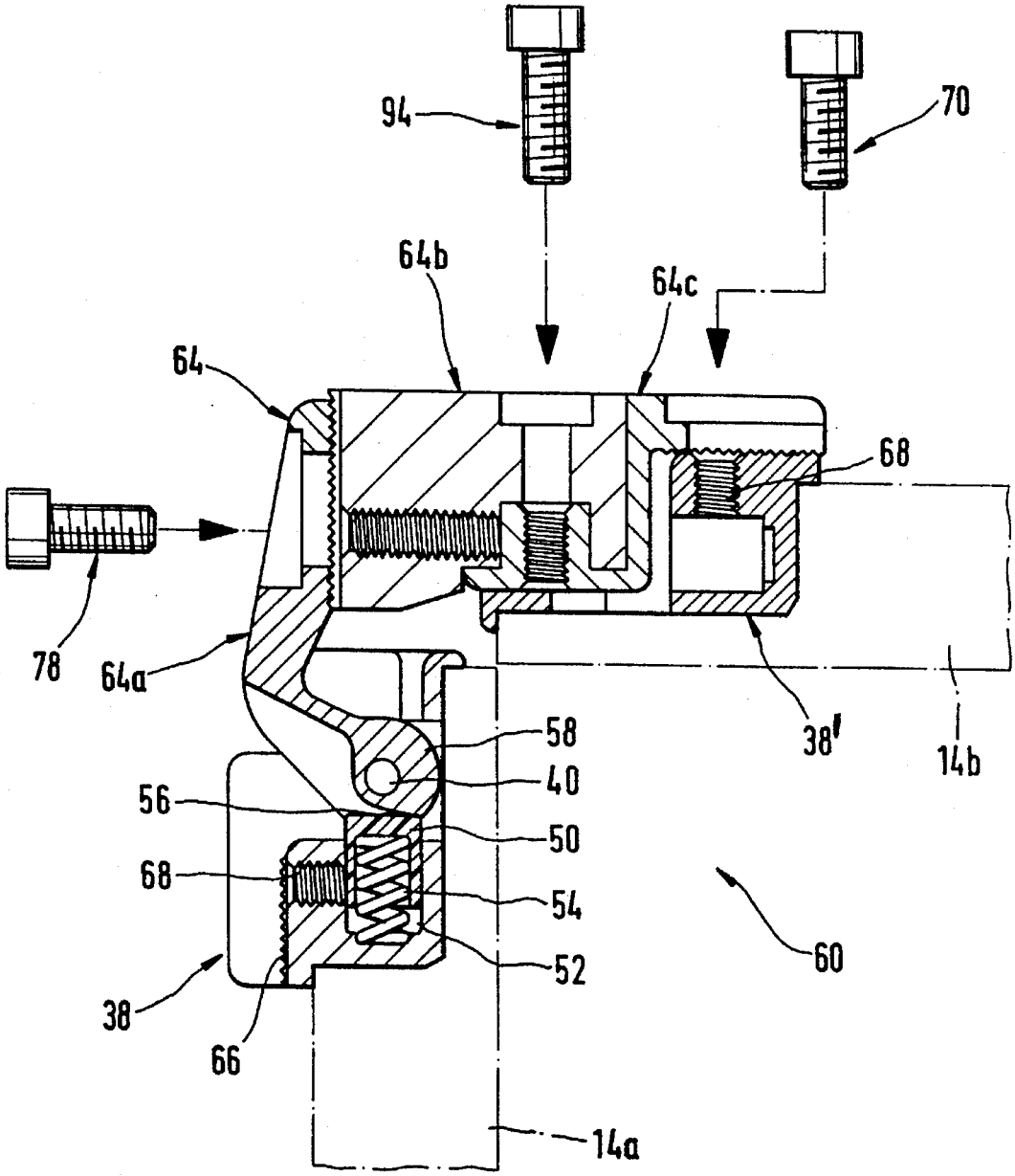
FIG. 5 is a longitudinal central section through an additional embodiment of a corner cabinet hinge configured in the manner of the invention.
Figure 6:
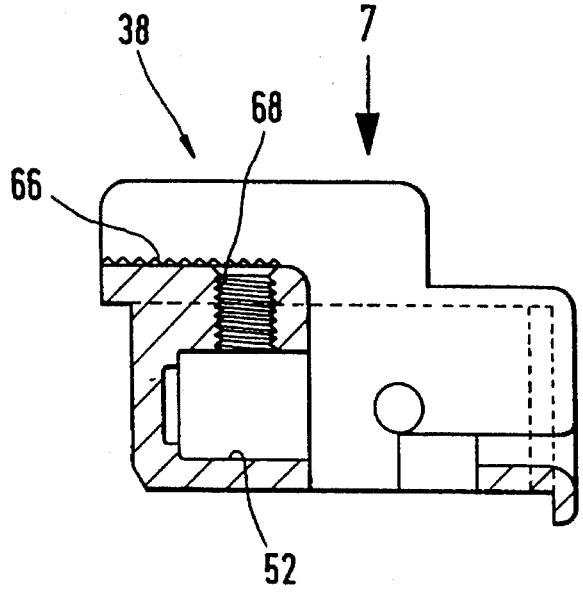
FIG. 6 is a longitudinal central section through the hinge cup of the corner cabinet hinge shown in FIG. 5.
Figure 7:
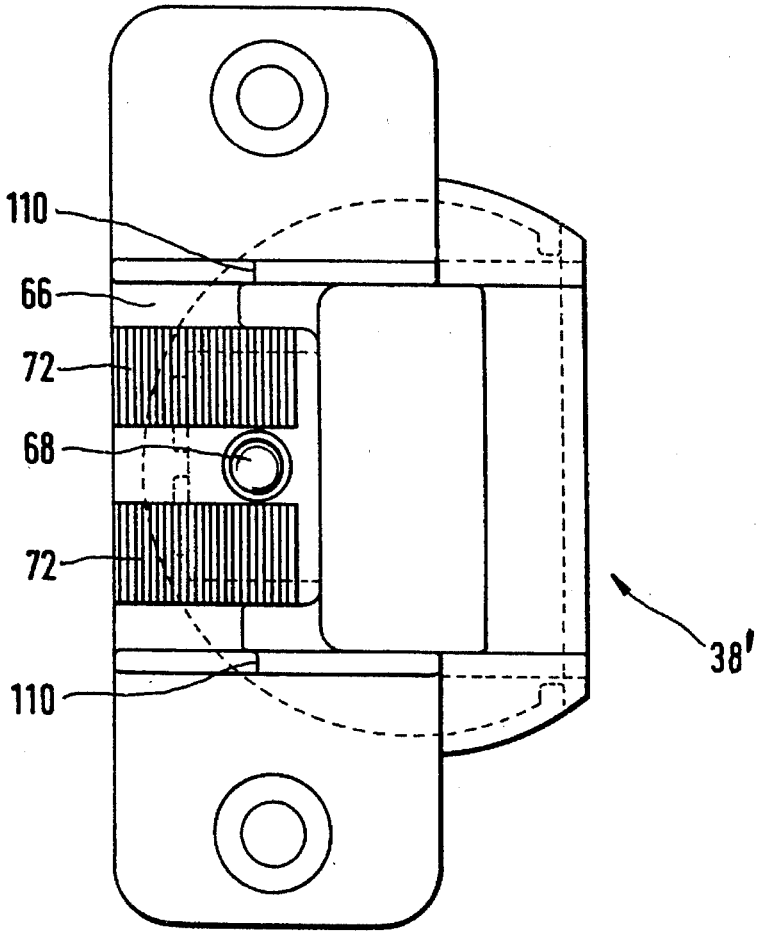
FIG. 7 is a top view of the hinge cup as seen in the direction of arrow 7 in FIG. 6.

In FIG. 5 there is shown a second embodiment of a corner cabinet hinge identified generally as 60 which, as regards the configuration of the mounting part held in the door panel 14*a* and configured as a hinge cup and the thrusting means provided in this mounting part, is identical to the hinge cup 38 of the embodiment described in FIGS. 1 to 4 and is also provided with the same reference number, so that it is sufficient in regard to the hinge cup 38 to describe hereinafter only those additional improvements which relate especially to the corner cabinet hinge 60. These additional improvements are made so as to be able to use the hinge cup also (instead of the mounting plate 32 provided in the case of hinge 30) as a mounting means (38') that can be sunk in door panel 14*b* for the adjustable mounting of the hinge arm here marked 64. The hinge cup 38 shown separately in FIGS. 6 and 7 is provided for this purpose above the opening 52 provided for the accommodation of the spring-biased pusher 50 with a basically flat support surface 66 into which a tap 68 is made at right angles for a screw 70 (FIG. 5). In one or more strip-like areas 72 triangular ridges or ribs project at equal intervals from the upper side of the support surface 66, parallel to the turning axis of the hinge.

Figure 8:
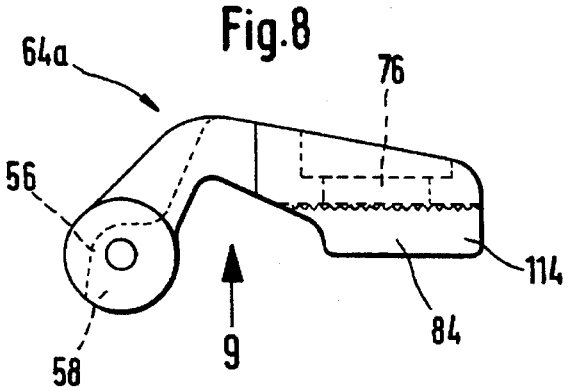
FIG. 8 is a side view of the bearing arm section of the corner cabinet hinge shown in FIG. 5.
Figure 11:
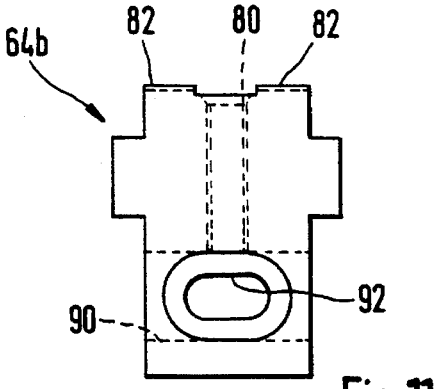
FIG. 11 is a view of the connecting arm section, as seen in the direction of arrow 11 in FIG. 10.
Figure 9:
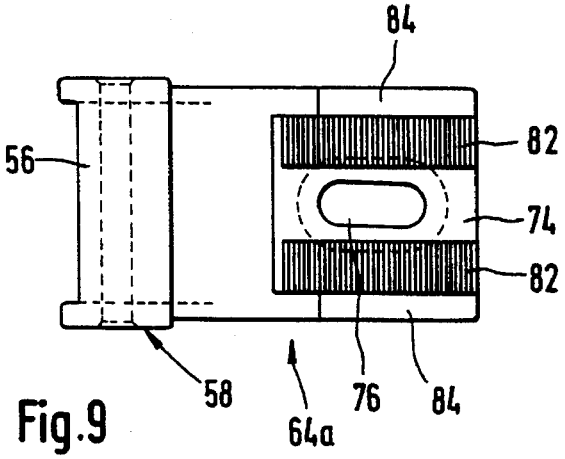
FIG. 9 is a view of the bearing arm section as seen in the direction of arrow 9 in FIG. 8.
Figure 12:
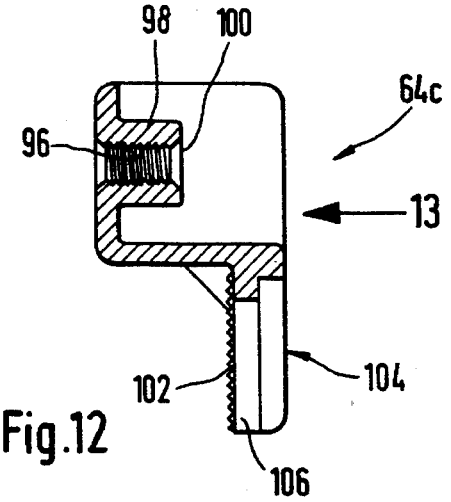
FIG. 12 is a longitudinal central section through the mounting arm section of the corner cabinet hinge shown in FIG. 5.
Figure 10:
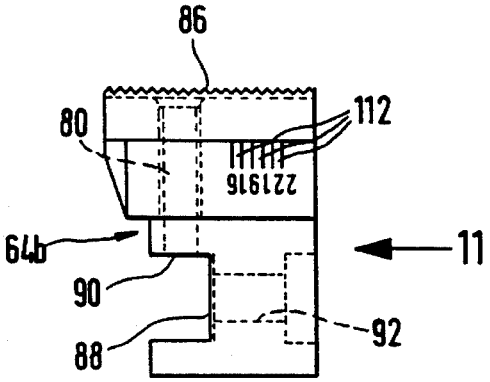
FIG. 10 is a side view of the connecting arm section of the corner cabinet hinge shown in FIG. 5.

The hinge arm 64 in turn is composed of three sections which are adjustable relative to one another, namely a pivot arm section 64*a* mounted pivotingly in the hinge cup 38 held in door panel 14*a* (FIGS. 8 and 9), a connecting section 64*b* (FIGS. 10 and 11) and a mounting arm section 64*c* (FIGS. 12 and 13) which can be fastened adjustably on the support surface 66 of the hinge cup 38 held in the door panel 14*b*.

The pivot arm section 64*a* has at its end in the hinge cup the bearing sleeve 58 that receives the pivot pin 40, and on which the cam surface 56 cooperating with the pusher 50 is formed. The end of the pivot arm section 64*a* remote from the hinge cup is provided with a basically flat fastening surface 74, and contains a slot 76 running at right angles to the hinge pivot axis, through which the shaft of a fastening screw 78 (FIG. 5) can be introduced and driven into a tap 80 in the connecting arm section 64*b*. The fastening surface 74 is in ten provided with two strip-like areas 82 in which parallel ridges of triangular cross section are provided, which run at right angles and thus parallel to the hinge pivot axis. Lateral lips projecting beyond the fastening surface 74 straddle the upper confronting part of the connecting arm section 64*b* and thus constitute a guide running in the direction of the slot 80 for the bearing arm section 64*a* on the connecting arm section 64*b*. On the connecting arm section 64*b* there is formed a fastening surface 86 facing the fastening surface 74 and having parallel ridges or ribs. The fastening surfaces 74 and 86 can thus be drawn together so that the ribs can mesh, by means of the fastening screw 78, thus permitting a longitudinal shifting of the bearing arm section 64*a* on the connecting arm 64*b* within the length of the slot 76.

The connecting arm section 64*b* has a second fastening surface 88 which is the bottom of a groove 90 running parallel to the hinge pivot axis. Through the connecting section a slot 92 opening in the fastening section 88 is created, through which a screw 94 (FIG. 5) can be driven into a tap 96 in a stub 98 of the mounting arm section 64*c*, the stub being fitted in the groove-like opening 90. The connecting arm section 64*b* is thus adjustable relative to the mounting arm 64*c*, parallel to the hinge pivot axis, within the range provided by the length of the slot 92, the adjustment being fixed by pressing together the fastening surface 88 of the connecting arm section 64*b* and the fastening surface 100 formed on the end face of the projection 98. Here too, ridges running transversely of the slot 92 are provided, which can be brought into engagement in a complementary relationship for positive retention in the set adjustment. The mounting arm section 64c also has a second fastening surface 102 on a projecting tongue 104 through which runs a longitudinal slot 106 with an open end at the free end of the tongue; this fastening surface 102 can be placed against the support surface 66 of the hinge cup 38'. The threaded shaft of the fastening screw 70 can be passed through the longitudinal slot 106 and driven into the tap 68 in the support surface 66. Complementary ridges or ribs of fastening surface 102, which run parallel to the ridges of the strip-like areas 72 of the support surface 66, are again brought into positive engagement when the fastening screw 70 is tightened, thus securing an adjustment made, which can be varied by loosening the fastening screw and shifting the mounting arm section 64c on the support surface 66 and then retightening the screw 70.

Figure 13:
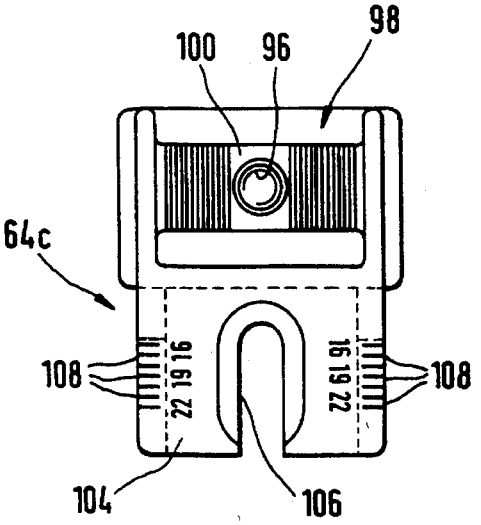
FIG. 13 is a view of the mounting arm section seen in the direction of arrow 13 in FIG. 12.

In FIG. 13 it can be seen that a scale 108 is engraved on each side of the tongue 104 of the connecting arm section 64*c*, and with it can be associated pointers 110 that can be read on the hinge cup 38'. Since the scale 108 is marked in such a manner that the settings pertaining to particular thicknesses of the panels 14*a* and 14*b* can be established by the pointers, tedious trial-and-error adjustments required when the thickness of the panels changes are eliminated.

A corresponding scale 112 is also provided on the connecting arm section 64*b*, which with a pointer 114 on the bearing arm section permits the correct adjustment of these two arm sections to the material thickness of the door panels.

I do not limit myself to any particular details of constructions set forth in this specification and illustrated in the accompanying drawings, as the same refers to and sets forth only certain embodiments of the invention, and it is observed that the same may be modified without departing from the spirit and scope of the claimed invention.

Having thus described the invention, what is claimed as new and desired to be secured by Letters Patent is as follows:

1. A hinge (30) for hanging a free door panel (14*b*) of a bipartite corner cabinet door, on a second door panel (14*a*) that is hung to turn on a carcase supporting wall, comprising:

two mounting parts, each associated with one of the door panels, which provide for the door panels to be turned by about 90 degrees from a position where the door panels (14*a*;14*b*) are held approximately at right angles to one another when the corner cabinet door is closed, to a position substantially in parallel alignment when the corner cabinet door (14) is open;

the first mounting part comprising a hinge cup (38) fixed in one of the door panels;

the second mounting part comprising a multi-angled hinge arm (64) journaled at one end on a pivot pin (40) provided in the hinge cup, and which is adjustably fastenable to the other door panel; said multi-angle hinge arm (64) comprising a bearing arm section (64*a*), a connecting arm section (64*b*) and a mounting arm section (64*c*) releasably joined to one another and succeeding one another longitudinally, wherein the bearing arm section (64*a*) is journaled in the hinge cup (38) and joined to the connecting arm section (64*b*) for adjustment in a first coordinate direction, the connecting arm section (64*b*) is attached non-rotatably to the other door panel for adjustment at right angles to the first coordinate direction, and the mounting arm section (64*c*) in turn is attached to mounting means (38') fastened to the associated door panel (14*b*) for adjustment in a coordinate direction running substantially at right angles to the aforesaid coordinate directions; and thrusting means, provided in the area where the multi-angled hinge arm is journaled in the hinge cup, which biases the free door panel (14*b*) to an angle of slightly more than 90° relative to the second door panel (14*a*) hinged on the carcase; and wherein the thrusting means comprises a pusher (52), mounted for displacement in the hinge cup (38) and resiliently biased toward the pivot pin (40), and a cam surface (56), formed on a bearing sleeve (58) surrounding the pivot pin (40) wherein the cam surface is engaged by the pusher (52).

2. The hinge according to claim 1 further comprising a mounting plate fastened to one of the door panels, and on which the mounting arm section of the hinge arm (64) is adjustably mounted, wherein the mounting plate is of a thickness which allows for the adaptation of the hinge arm to different thicknesses of the door panels by holding the hinge arm at various distances from the inside surface of the associated door panel.

3. The hinge according to claim 1, wherein the bearing arm section (64*a*) and the connecting arm section (64*b*) are adjustable in a first coordinate direction relative to each other, defined as being at right angles with the direction of adjustment between the mounting arm section (64*c*) and the mounting means (38') on the associated door panel, and wherein the connecting arm section (64*b*) and the mounting arm section are adjustable in a second coordinate direction defined as being parallel to the longitudinal central axis of the pivot pin (40).

4. The hinge according to claim 3, wherein the mounting means (38' ) is fastened sunken in the associated door panel (14*b*).

5. The hinge according to claim 4, wherein the mounting means comprises a fastening surface (74) and a confronting support surface (66) for an associated fastening surface (102) provided on the mounting arm section (64*c*), and wherein a slot (76) is provided in the fastening surface (74) which is penetrated by the shaft of a fastening screw (78) that can be driven into a tap (68) in the confronting support surface (66).

6. The hinge according to claim 5, wherein in the confronting support surface and the associated fastening surface (66; 102) parallel ridges running at right angles to the slot (76) are provided, which can be forced into meshing engagement by tightening the fastening screw (78).

7. The hinge according to claim 4, wherein confronting fastening surfaces which can be brought into contact with one another are provided on the mounting arm section (64*c*) and in the connecting arm section (64*b*), and that in one of the arm sections a slot is provided which is pierced by the shaft of a fastening screw (94) which can be driven into a thread (96) in the fastening surface of the other arm section.

8. The hinge according to claim 7, wherein parallel ridges are provided in the confronting fastening surfaces (100;88)

at right angles, in each case, to the slot (92), and the confronting fastening surfaces can be forced into meshing engagement when the fastening screw (94) is tightened.

9. The hinge according to claim 4, wherein fastening surfaces (82; 74) which can be brought into contact with one another are provided in the connecting arm section (64*b*) and in the bearing arm section (64*a*), and that a slot (76) is provided in one of the arm sections and is pierced by the shaft of a fastening screw (78) which can be screwed into a thread in the fastening surface of the other arm section.

10. The hinge according to claim 9, wherein parallel ridges are provided in the confronting fastening surfaces (82; 74) of the connecting arm section (64*b*) and of the bearing arm section (64*a*), and run at right angles to the slot (76), and can be forced into meshing engagement by tightening the fastening screw (78).

11. The hinge according to claims 4 wherein the mounting means holding the mounting arm section (64*c*) fastened sunken in the associated door panel (14*b*), and the hinge cup (38) pivotingly holding the bearing arm section (64*a*), are configured as identical components which have both bores to accommodate the pivot pin (40) in the cup interior as well as a support surface (66) for the adjustable mounting of a mounting arm section (64*c*).

12. The hinge according to claim 3, wherein on the bearing arm section (64*a*) and on the connecting arm section (64*b*) a scale (112) permitting the relative positioning of the parts to one another is provided on one of the arm sections, and a pointer (114) on the other.

13. The hinge according to claim 12, wherein the scale (112; 108) is inscribed with numerals permitting the reading of the correct setting of the door panels (14*a;* 14*b*) of different thickness.

14. The hinge according to claim 3, wherein on the mounting arm section (64*c*) and on the mounting means holding it, a scale (108) permitting the position of the parts relative to one another to be read is provided on either the mounting arm section or the mounting means and a pointer (110) on the other part is provided for reading the scale, on the part not having the scale.

15. The hinge according to claim 1, wherein the hinge cup (38) journaling the free end of the hinge arm (34; 64) is provided in the door panel (14*a*) that is hung on the carcase.

16. The hinge according to claim 15, wherein the hinge arm (34; 64) is fastened adjustably on the free door panel (14*b*).

* * * * *